US006540122B1

(12) United States Patent
Petersen

(10) Patent No.: US 6,540,122 B1
(45) Date of Patent: Apr. 1, 2003

(54) BELT CLIP FOR A PORTABLE PRINTER

(75) Inventor: Steve Petersen, Lincoln, RI (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/922,120

(22) Filed: Aug. 3, 2001

Related U.S. Application Data

(60) Provisional application No. 60/223,226, filed on Aug. 4, 2000.

(51) Int. Cl.[7] ..... A01K 97/04

(52) U.S. Cl. ..... 224/197; 224/268; 224/272; 224/930

(58) Field of Search ..... 224/197, 268, 224/269, 272, 930

(56) References Cited

U.S. PATENT DOCUMENTS

| | | | | |
|---|---|---|---|---|
| 3,810,550 A | * | 5/1974 | Longarzo | 211/69.6 |
| 4,828,153 A | | 5/1989 | Guzik et al. | |
| 4,845,650 A | * | 7/1989 | Meade et al. | 224/241 |
| 4,974,764 A | | 12/1990 | Cantwell | |
| 5,097,997 A | | 3/1992 | Kipnis et al. | |
| 5,331,721 A | | 7/1994 | Raum, Sr. | |
| 5,346,784 A | | 9/1994 | Scheid | |
| 5,379,490 A | | 1/1995 | Wandt et al. | |
| 5,410,141 A | | 4/1995 | Koenck et al. | |
| 5,528,770 A | | 6/1996 | Castilla et al. | |
| 5,584,423 A | * | 12/1996 | Wang | 224/197 |
| 5,711,424 A | | 1/1998 | Kiesow | |
| 5,730,342 A | * | 3/1998 | Tien | 224/197 |
| 5,730,348 A | * | 3/1998 | Tien | 224/271 |
| 5,791,019 A | | 8/1998 | Jeong | |
| 5,860,753 A | | 1/1999 | Beck et al. | |
| 5,881,986 A | * | 3/1999 | Hegarty | 248/442.2 |
| 6,004,053 A | | 12/1999 | Petteruti et al. | |
| 6,032,337 A | | 3/2000 | Rankin, Jr. et al. | |

* cited by examiner

*Primary Examiner*—Stephen K. Cronin
(74) *Attorney, Agent, or Firm*—Kenneth J. Lukacher

(57) ABSTRACT

A belt clip for a miniature portable printer is provided which enables universal movement (rotation and tilt) of the belt clip with respect to the housing of the portable printer. The belt clip assembly includes a clip portion, a ball connected by a shaft to the clip portion, a socket formed by a semi-spherical recess on the printer housing, and a retainer member for retaining the ball in the socket when the belt clip is attached to the printer housing. The retainer member has an opening having an interior shaped to conform to the spherical surface of the ball. When the ball is received in the socket, the shaft is received in the opening of the retainer member, such that the ball is slidable along the recess of the housing and the interior of the retainer member. Universal is provided by rotation of the ball in the socket.

15 Claims, 5 Drawing Sheets

BELT CLIP FOR A PORTABLE PRINTER

This application claims the benefit of priority to U.S. Provisional Patent Application No. 60/223,226, filed Aug. 4, 2000, which is herein incorporated by reference.

FIELD OF THE INVENTION

The present invention relates to a belt clip for a portable printer, and relates particularly to, a belt clip capable of universal movement (rotation and tilt) with respect to the housing of a portable printer. The universal movement of the belt clip promotes ease of carrying the portable printer on the belt of a user, while allowing the battery compartment of the housing of the printer, normally blocked by the belt clip, to be easily accessed by rotating the belt clip to a position which does not block the battery compartment or the cover to the compartment. Although the belt clip is described herein for a portable printer, it may be applied to any portable electronic device.

BACKGROUND OF THE INVENTION

Belt clips are used to attach a portable electronic device to the belt of a user, such that the user can carry the device on their belt. Examples of such electronic devices often having belt clips include cell phones, pagers, and cassette or CD players. One typical belt clip design has an elongated member secured at one end to the top of the back of a housing of a device (or a container holding the device) to form a clip with the back of the housing, such that a belt can be held between the elongated member and the housing. Often, the elongated member is hinged to the back of a housing of a device, and biased, such as a spring, against the back surface to retain a belt between the elongated member and the housing. The bottom of the elongated member may have a hook to facilitate retaining of the belt. Examples of such belt clips are described in U.S. Pat. Nos. 6,032,337; 5,791,019; 5,379,490; 5,528,770; and 4,828,153. Sometimes, the elongated member is part of a U-shaped clip attached along its length to the back of the device as shown, for example, in U.S. Pat. No. 5,331,721.

Belt clips may be removably attached to the housing of a portable electronic device by a slidable member coupled to the belt clip having edges which can be positioned into grooves of the housing. One reason is to allow a user to remove the belt clip if not needed, and another, is to enable access to the device's battery compartment and its cover/door blocked by the belt clip. The small size of portable electronic devices generally requires the belt clip to extend over the battery compartment on the backside of devices. One solution to accessing a battery compartment is described in U.S. Pat. No. 5,346,784, in which the belt clip is attached to the door of a battery compartment of a portable electronic device, e.g., pager, such that by sliding the belt clip, the door is removed to access the battery compartment.

Miniature portable printers may be worn on a user's belt by a strap through hooks on the device, such as described in U.S. Pat. No. 5,860,753, or have an opening at the back of the printer for a hook which attaches to the belt of a user, such as described in U.S. Pat. No. 6,004,053. However, to integrate a belt clip designs described above on a portable printer, such as the portable printer of U.S. Pat. No. 6,004,053, to obtain a desired vertical orientation of the printer when worn, causes problems in accessing the printer's battery compartment since the belt clip would extend over and block at least part of the battery compartment and its cover, thereby making access to the compartment difficult.

In this case, the belt clip would typically have to be made detachable from the printer, thus requiring additional user steps to detach and attach the belt clip each time the battery of the printer needs to be replaced. Accordingly, it would be desirable to provide a belt clip for a portable printer that can be readily moved to unblock the battery compartment without requiring detachment of the belt clip from the printer housing.

Although belt clips of portable electronic devices may be located at various points along one's belt, typical belt clips rigidly hold the device to the user's body. This greatly minimizes the amount of possibly movement of device relative to body position and motion of the user wearing the device, and often makes wearing the device uncomfortable. This especially can occur when a user is seated. Accordingly, it would further be desirable to provide a belt clip for a portable electronic device, such as a portable printer, which enables universal movement of rotation and tilt of the belt clip with respect to the housing of the device, thereby making the device more comfortable for the user to wear on their belt.

U.S. Pat. No. 5,410,141 describes a modular hand-held data capture system having a handheld data terminal which, when an automatic optical reader unit is applied to the module as an end cap, has a swivel type belt clip on the back of the terminal. Such a swivel belt clip is not capable of universal movement. In another configuration of the hand-held data terminal of this patent, a receptacle compatible with a portable printer is provided without any belt clip.

SUMMARY OF THE INVENTION

It is the principal object of the present invention to provide an improved belt clip for a miniature portable printer.

Another object of the present invention to provide an improved belt clip which enables universal movement, rotation and tilting, of the belt clip with respect to the housing of a portable printer.

A further object of the present invention to provide an improved belt clip for a portable printer which allows the belt clip to be easily rotated to unblock a battery compartment in the printer housing, normally blocked by belt clip portion, without requiring detachment of the belt clip from the printer.

A still further object of the present invention is to provide a belt clip for a portable printer in which the belt clip allows the printer to move more freely with the movement of the user than prior art belt clips.

Briefly described, the belt clip assembly has a one-piece clip portion having a closed U-shaped first end from which two members extend and taper towards each other to an open second end of the clip portion, a ball (or spherical member) connected by a shaft to one member of the clip portion, a socket formed by a semispherical recess in the printer housing for receiving the ball, and a retainer member for retaining the ball in the socket when the belt clip assembly is attached to the printer housing. The retainer member has a side notch to an opening which extends through the retainer member, and a concave interior in the opening shaped to conform to the spherical surface of the ball. When the ball is received in the socket, the shaft is received in the opening of the retainer member, such that the ball is slidable along the recess of the housing and the concave interior of the retainer member. The retainer member is attached, such as by screws, to the printer housing to retain the ball in the socket. Universal movement of rotation and tilt of the clip portion with respect to the housing is provided by rotation of the ball in the socket. At the first end of the clip portion, the two members are rigidly coupled to each other, but sufficiently flexible to be temporarily separated at the second end of the clip portion to clip onto a belt received between the two members. At the second end of the clip portion, the two members either meet, or are close to each other to retain a belt, and then may curve away from each other to form an elongated opening to facilitate guiding the belt between the two members.

The belt clip may be provided by two molded parts, in which the clip portion, ball and connecting shaft components are integrated in a first molded part, and the retainer member is a second molded part.

The universal movement of the belt clip allows it to be rotated to unblock a battery compartment in the printer housing, normally blocked by the clip portion of the belt clip, without requiring detachment of the belt clip from the printer housing. Further, when the portable printer is worn on the belt of a user, the universal movement of the belt clip allows the portable printer to move more freely with the movement of the user, and thus, the portable printer is more comfortable for the user to wear.

The belt clip is described herein for use with a portable printer, but may be used with other portable electronic devices, such as cell phones, pagers, cassette players, CD players, or the like.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
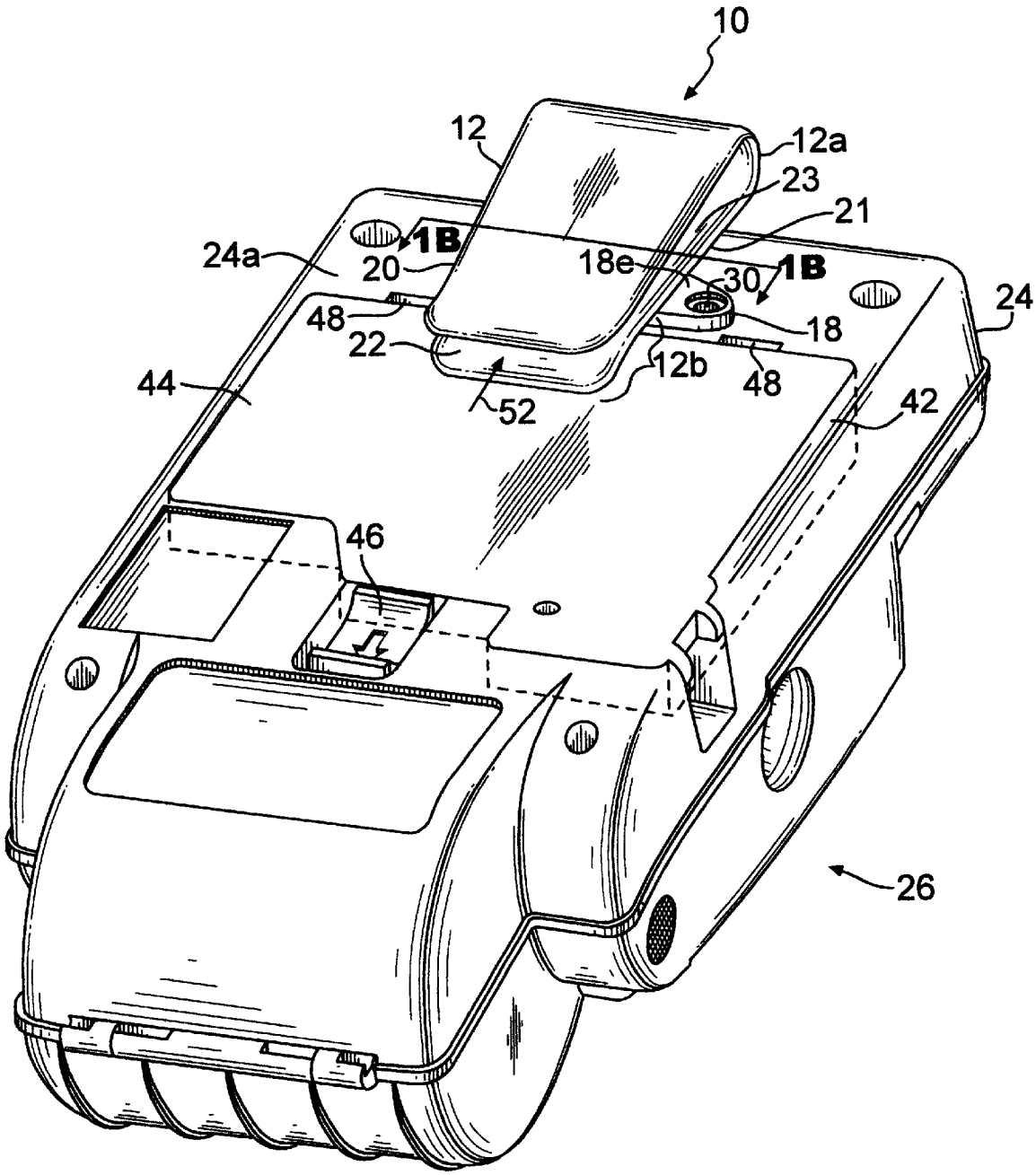
FIG. 1 is a perspective view of the belt clip in accordance with the present invention when attached to the housing of a portable printer.
Figure 1A:
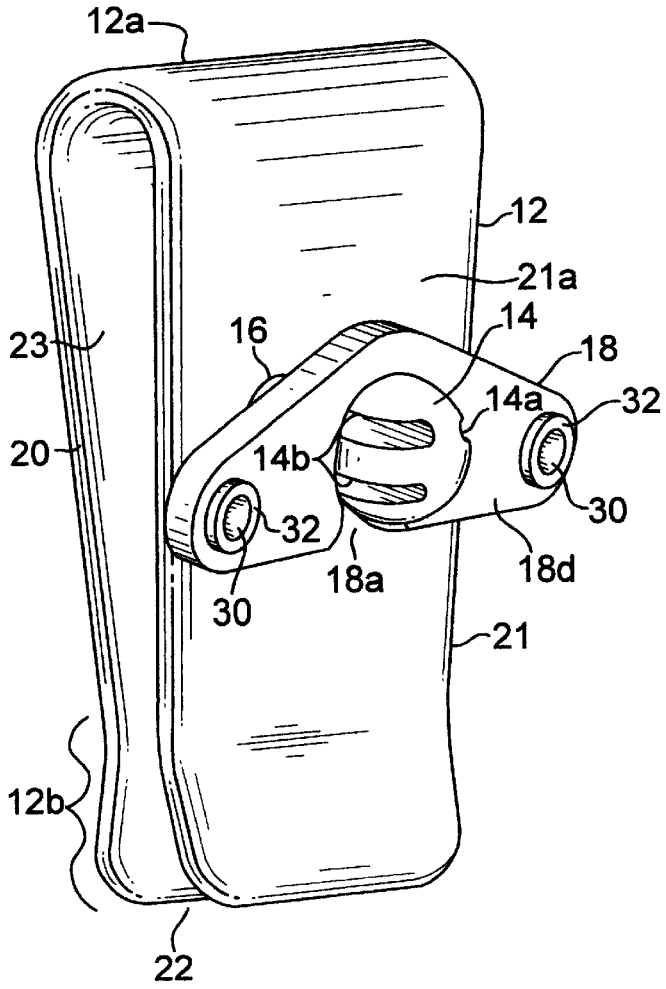
FIG. 1A is a perspective view of the belt clip of FIG. 1 without the printer housing.
Figure 1B:
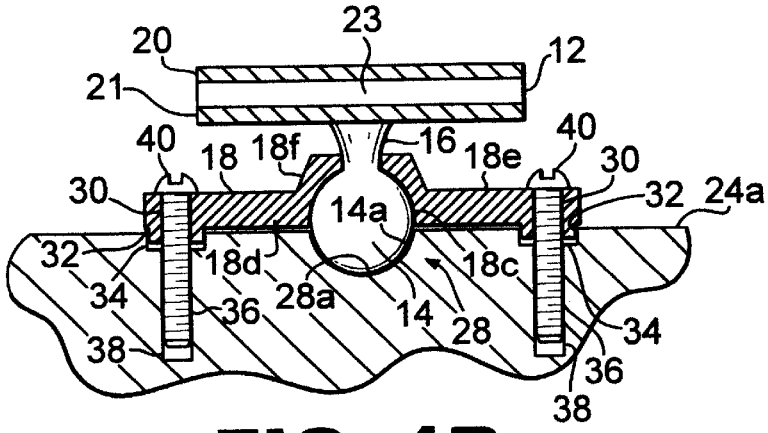
FIG. 1B is a partial cross-sectional view of the belt clip along line 1B—1B of FIG. 1.

Referring to FIGS. 1, 1A and 1B, the belt clip 10 is shown having a clip portion 12, a ball (spherical member) 14 connected to clip portion 12 by a shaft 16, and a retainer member 18. Clip portion 12 has a generally U-shape first end 12*a* from which two members 20 and 21 extend, each from one of the two sides of the U-shape first end, and curve tapering towards each other to form an open second end 12*b* of the clip portion. The ball 14 is connected by shaft 16 to the lower surface 21*a* of member 21 of the clip portion 12. Shaft 16 may widen in diameter near member 21. At the second end 12*b*, the two members 20 and 21 either meet, or are close to each other to retain a belt between members 20 and 21, and then curve away from each other to form an opening 22 to facilitate guiding a belt between members 20 and 21 into a tapered slot 23 located between members 20 and 21. Members 20 and 21 are rigidly coupled to each other at end 12*a*, but sufficiently flexible to be temporarily separated at the second end 12*b*, i.e., spread apart from each other in response to receiving of a belt between the members 20 and 21.

Preferably, the width of the clip portion 12 decrease example, at end 12*a* the clip portion may be about 1.25 inches wide and decease at the tips of members 20 and 21 at end 12*b* to about ¾ inches wide. Further, the length of the clip portion 12 may be, for example, about 2.25 inches, and the ball 14 may be, for example about ½ inch in diameter with shaft 16, for example, about ⅛ inches in length. However, any clip having two members capable of retaining a belt may provide the clip portion, and other dimensions of the clip portion, ball and shaft components may be used.

Figure 3A:
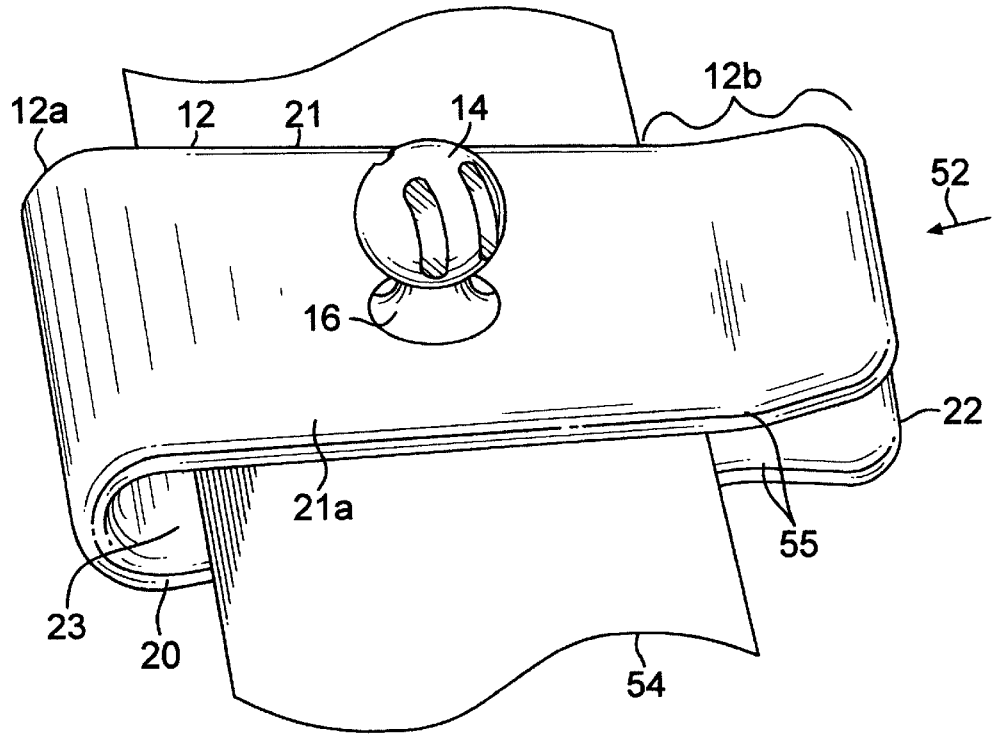
FIGS. 3A and 3B are top and bottom perspective views, respectively, of integrated clip portion, shaft, and of the belt clip of FIG. 1.
Figure 3B:
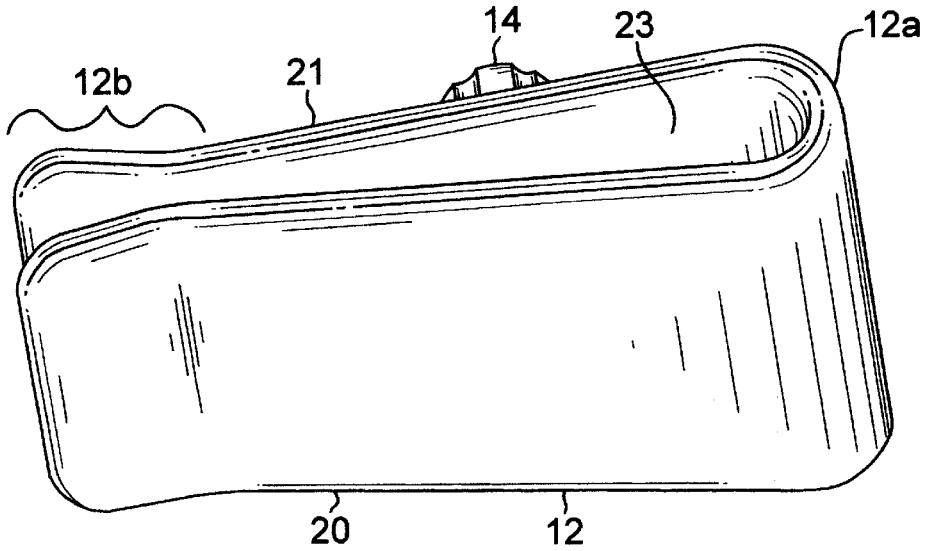

In addition, members 20 and 21 of clip portion 12 is preferably provided by a single continuous piece of molded material including ball 14 and shaft 16, such as of Nylon or Delrin, manufactured by Dupont, Inc., or other similar durable material. Ball 14, when molded, may have gaps 14*b* (FIGS. 1A and 3B) in its surface 14*a*, or surface 14*a* may be continuous. However, members 20 and 21, ball 14, and shaft 16 may be two or more separate components joined thereto by glue or other attachment means in a unitary construction.

A housing 24 of a portable printer 26 is shown in FIGS. 1 and 1A to represent a typical housing of a portable printer having a backside 24*a*. Housing 24 preferably is made of molded material, such as Texin manufactured by Bayer, Inc. Other material may also be used, such as plastic. A socket 28 (FIG. 1B) is provided by a semispherical recess 28*a* on the back 24*a* of housing 24. The recess 28*a* is approximately shaped in accordance with the spherical surface 14*a* of ball 14.

Figure 2A:
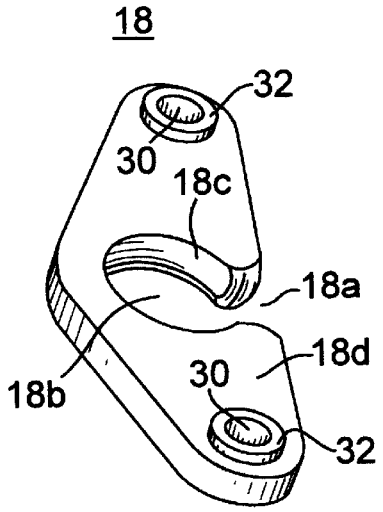
FIGS. 2A and 2B are top and bottom perspective views, respectively, of the retainer member of the belt clip of FIG. 1.
Figure 2B:
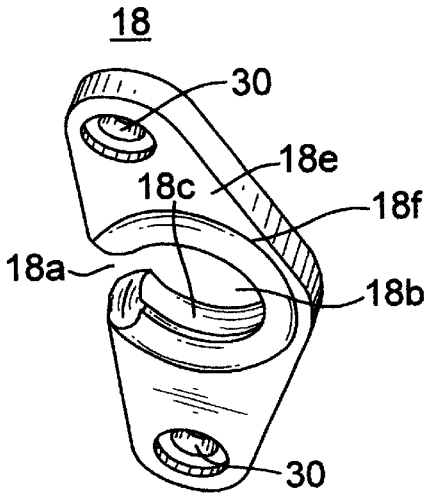

A retainer member 18 has a side notch (or side opening) 18*a* to an opening 18*b* in the retainer member 18 as best shown in FIGS. 2A and 2B, such that shaft 16 may be located in opening 18*b* through notch 18*a*. The opening 18*b* of the retainer member has a concave interior 18*c* shaped to conform to the outer spherical surface of ball 14 when the ball is located in socket 28, such that the ball can smoothly rotate in the socket. A raised ridge 18*f* extends about opening 18*b* at the upper surface 18*e* of the retainer member 18. The interior of the raised ridge may be outwardly sloped. For example, the raised ridge 18*f* may be ⅛ inch high. At upper surface 18*e* of the retainer member 18, opening 18*b* has a diameter larger than the diameter of shaft 16 to allow clip portion 12 to move or pivot to tilted positions with respect to housing 24 as the ball 14 is rotated in socket 28. The amount of the tilt angle depends on the distance between the ball and member 21 of the clip portion 12 along shaft 16 and the height of ridge 18*f*. Retainer member 18 may be of molded material, which may be the same as the material of housing 24, or the material of the clip portion 12 or other rigid material.

The retainer member 18 has two holes 30, one at each end of the retainer member, which extends through the retainer member. At the bottom surface 18*d* of the retainer member 18, circular protrusions 32 (FIGS. 1A, 1B, and 2A) extend from lower surface 18*d* about holes 30. These protrusions 32 are sized to be received in two circular recessed openings 34 FIG. 1B) to holes 36 in housing 24. Holes 36 each extend into molded wells 38 in the interior of housing 24, as shown in FIG. 1B. Screws 40 through holes 30 of the retainer member 18, and then holes 36 of housing 24, attach the retainer member 18 to housing 24, and thus retain the ball 14 in socket 28, and thereby attach belt clip assembly 10 to housing 24. Each of the holes 36 of the housing 24 may be threaded for such screws 40. Other means than screws 40 may be used to attach the belt clip to housing 24.

In a two-piece belt clip 10, i.e., clip portion 12 with integrated shaft and ball forming a first piece, and retainer member 18 forming a second piece, is assembled as follows. Ball 14 is located in the socket 28. Then, the retainer member receives the shaft 16 in opening 18*b* through notch 18*a*, such that interior 18*c* faces surface 14*a* of ball 14. When the ball 14 and retainer member 18 are properly aligned with respect to the socket 28, protrusions 32 of the retainer member are located in recessed openings 34 of housing 24. The retainer member 18 is attached to the housing 24 by two screws 40 through its holes 30 of the retainer member and then holes 36 of the housing, and tightened. The lower surface 18*d* of retainer member 18 need not be flush with surface 24*a* of housing 24, so long as sufficient force is applied onto ball 14 by retainer interior 18*c* and recess 28*a*, such that the ball can slide in socket 28 to rotate and/or tilt (angle or pivot) the belt clip to multiple positions. Retainer interior 18*c* may be considered the upper part of socket 28, while recess 28*a* the lower part of the socket 28.

Optionally, the opening to hole 30 may be recessed as shown in FIGS. 1 and 2B, such that the head of screws 40 may be completely or partially recessed in the top surface 18*e* of retainer member 18. Further, instead of protrusions 32 and recessed openings 34, similar protrusions may be provided about holes 36 in housing 24 and then received in similar circular recessed openings about holes 30 at surface 18*d* of the retainer member.

As shown in FIG. 1, the housing 24 has a battery compartment 42 (shown in dashed lines) and a cover 44 over compartment 42. Latch 46 provides for release of the cover 44 which is held by hinges (not shown) extending from cover 44 into openings 48 of housing 24. The clip portion 12 when worn by a user of the portable printer is generally in an orientation (or position) approximately parallel with the length of the housing 24. The clip portion 12 may be rotated and/or tilted about 90 degrees to enable access to the battery compartment and its cover, indicated by arrow 50 in the example shown in FIG. 4, or to another position which unblock or substantially unblocks the compartment. Thus, a user can access the battery compartment of the portable printer without removal of the belt clip 10, such that the battery may be replaced. Afterwards, the clip portion 12 may be rotated back to its original position shown in FIG. 1.

Universal movement, rotation and tilt, of the belt clip portion of the assembly 10 with respect to the housing is provided by rotation of the ball 14 in socket 28. The freedom of universal movement depends on the amount screws 40 are tightened. In other words, tightening the screws 40 increases the frictionally force against the outer surface 14*a* of ball by the socket and retainer member, reducing the ease at which the ball slides in the socket, while untightening the screws 40 decreases the frictionally force against the surface 14*a* of the ball by the socket and retainer member, increasing the ease at which the ball rotates or slides in the socket. The ball 14 may be self-lubricating in socket 28 when the ball is composed of material, such as earlier described Delrin, which enables self-lubrication against the bearing surface 18*c* and/or 28*a* (FIG. 1B) of the socket. This promotes durability of belt clip 10.

With the belt clip 10 attached to the housing 24, the user (or other person) attaches the housing to their belt by guiding the belt through opening 22 in the direction of arrow 52 (FIG. 1) temporarily separating members 20 and 21 of the clip portion 12 until the belt is positioned in slot 23. For example, a belt 54 is shown in slot 23 in FIG. 3A. The belt may be removed from belt clip 10 by pulling the belt in a direction opposite to arrow 52. The clip portion 12 may grip the belt by members 20 and 21 at bend 55 (FIG. 3A) in each such member, where the members are closest to each other, if the belt is of sufficiently wide width. The universal movement of the belt clip 10 enables the device to move freely as the user's body position changes.

Figure 4:
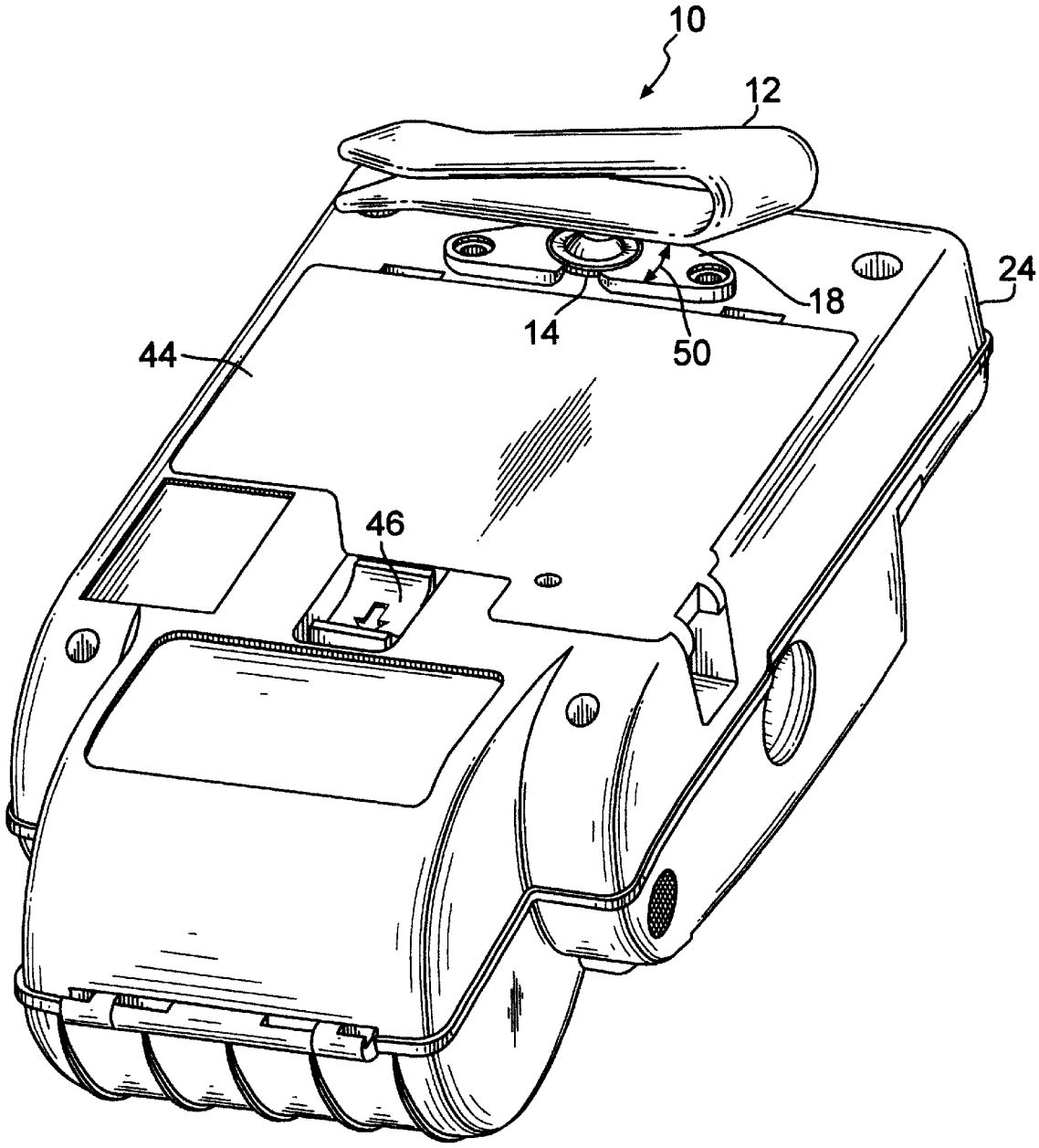
FIG. 4 is another perspective view of the belt clip of FIG. 1 in which the belt clip has been rotated to unblock the battery compartment of the printer's housing.

Although the belt clip 10 is shown attached to the housing of portable printer in FIGS. 1 and 4, other housings of a portable printer, or other types of portable electronic devices, may be used with the belt clip. Preferably, the belt clip 10 when applied to a portable printer, which can print labels, the printer weighs less than 2 pounds.

From the foregoing description, it will be apparent that there has been provided an improved belt clip for a portable printer. Variations and modifications in the herein described belt clip, and assembly thereof, in accordance with the invention will undoubtedly suggest themselves to those skilled in the art. Accordingly, the foregoing description should be taken as illustrative and not in a limiting sense.

What is claimed is:

1. A belt clip assembly for a portable device having a housing, said belt clip assembly comprising:

a clip portion;

a spherical member and a shaft connecting said spherical member to said clip portion;

a socket provided by the housing of the device;

a retainer member attachable to said housing having an opening through which extends said shaft, in which said spherical member is rotatable in said socket to position said clip portion when said spherical member is retained in said socket by said retainer member; and wherein said device represents a portable printer, and said belt clip assembly further comprises the housing of said portable printer.

2. The assembly according to claim 1 wherein said clip portion, shaft, and spherical member are of a unitary construction.

3. The assembly according to claim 1 wherein said spherical member in said socket provides for universal movement of the clip portion with respect to the housing provided by rotation of the spherical member retained in said socket by said retainer member.

4. The assembly according to claim 1 Wherein said retainer member has an interior surface shaped to receive said spherical member when said spherical member is in said socket.

5. The assembly according to claim 1 wherein said universal movement of said clip portion enables the portable device when the portable device is worn by a user to move freely with movement of the user.

6. The assembly according to claim 1 wherein said retainer member has an opening to said opening of the retainer member to enable said shaft to be located in said opening of the retainer member.

7. The assembly according to claim 1 wherein said socket comprises a recess on the housing of the device shaped to receive said spherical member.

8. The assembly according to claim 7 wherein said spherical member is slidable in said socket against the friction applied to said spherical member by said retainer member and the surface of the recess.

9. The assembly according to claim 1 wherein said clip portion comprises a U-shape first end and two members extending from said first end to an open second end.

10. The assembly according to claim 9 wherein said two members taper towards each other to form a slot into which a belt is receivable.

11. The assembly according to claim 10 wherein said two members at said second end of said clip portion curve away from each other to provide a guide for said belt to said slot.

12. A belt clip assembly for a portable device having a housing, said belt clip assembly comprising:

a clip portion;

a spherical member and a shaft connecting said spherical member to said clip portion;

a socket provided by the housing of the device;

a retainer member attachable to said housing having an opening through which extends said shaft, in which said spherical member is rotatable in said socket to position said clip portion when said spherical member is retained in said socket by said retainer member; and the housing of said device, wherein said housing has a battery compartment which is at least partially blocked by said clip portion when said clip portion is rotated in a first direction with respect to the housing, and at least substantially unblocked when said clip portion is rotated in a second direction with respect to said housing.

13. A portable printer having a belt clip comprising:

a housing having at least means for printing;

a belt clip coupled to said housing; and means for enabling universal movement of said belt clip with respect to said housing by rotation and tilt of said belt clip, wherein said printer weighs less than two pounds, and said means for enabling universal movement comprises a spherical member coupled to said belt clip and a socket, and means for attaching a retainer member to said housing to retain said spherical member in said socket while enabling universal movement of said belt clip by rotation of said spherical member in said socket.

14. A method for attaching a belt clip having a clip portion to a portable printer comprising the steps of:

providing a housing for a portable printer;

providing a spherical member coupled to said clip portion;

providing a socket on said housing; and attaching a retainer member to said housing to retain said spherical member in said socket to allow said spherical member to rotate in said socket and thereby move the clip portion with respect to the housing.

15. A method for attaching a belt clip having a clip portion to the housing of a portable device comprising the steps of:

providing a spherical member coupled to said clip portion;

providing a socket on the housing of the device; and attaching a retainer member to said housing to retain said spherical member in said socket to allow said spherical member to rotate in said socket and thereby move the clip portion with respect to the housing, wherein said housing has a battery compartment at least partially blocked by said clip portion and said clip portion is positionable to at least substantially unblock said battery compartment.

* * * * *